US006324358B1

(12) United States Patent
Sahara

(10) Patent No.: US 6,324,358 B1
(45) Date of Patent: Nov. 27, 2001

(54) IMAGE FORMING APPARATUS WITH MULTI-SPEED INTERMEDIATE TRANSFER MEMBER

(75) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/411,390

(22) Filed: Oct. 4, 1999

(30) Foreign Application Priority Data

Oct. 5, 1998 (JP) ..... 10-283034
Sep. 16, 1999 (JP) ..... 11-261974

(51) Int. Cl.[7] ..... G03G 15/16; G03G 15/20
(52) U.S. Cl. ..... 399/66; 399/302
(58) Field of Search ..... 399/66, 297, 298, 399/299, 302, 308, 300, 85, 223, 310, 313

(56) References Cited

U.S. PATENT DOCUMENTS 4,935,788 * 6/1990 Fantuzzo et al. ..... 399/299
5,138,389 * 8/1992 Randall ..... 399/302
5,357,330 * 10/1994 Hauser ..... 399/302
5,452,064 * 9/1995 Inomata ..... 399/299
5,572,304 * 11/1996 Seto et al. ..... 399/313
5,612,771 * 3/1997 Yamamoto et al. ..... 399/66 X
5,629,761 * 5/1997 Theodoulou et al. ..... 399/298 X
5,671,472 * 9/1997 Snelling ..... 399/308
5,765,082 * 6/1998 Numazu et al. ..... 399/299
5,870,649 * 2/1999 Gotoh ..... 399/66
5,930,556 * 7/1999 Imamiya ..... 399/66
5,940,668 * 8/1999 Tanigawa et al. ..... 399/302
5,983,060 * 11/1999 Namekata et al. ..... 399/297
6,016,419 * 1/2000 Hirai ..... 399/297 X

* cited by examiner

*Primary Examiner*—Sandra Brase
(74) *Attorney, Agent, or Firm*—Fitzpatrick, Cella, Harper & Scinto

(57) ABSTRACT

An image forming apparatus includes a plurality of image bearing members for bearing an image of plural colors, respectively, an intermediate transfer member and a controller for controlling the peripheral speed of the transfer member. For this apparatus, selection is made possible between a first mode of sequentially transferring the image of plural colors onto the intermediate transfer member by use of the plurality of image bearing members for the transfer of the image of plural colors on the intermediate transfer member to a transfer material, and a second mode of transferring a monochromatic image onto the intermediate transfer member by use of a predetermined image bearing member for the transfer of the monochromatic image to a transfer material. When the second mode is selected and the length of the monochromatic image in the moving direction of the intermediate transfer member is shorter than the distance from a first position of transferring the monochromatic image on the predetermined image bearing member onto the intermediate transfer member to a second position of transferring the monochromatic image on the intermediate transfer member to the transfer material in the moving direction of the intermediate transfer member, the controller switches the peripheral speed of the intermediate transfer member from a first speed of transferring the monochromatic image from the image bearing member to the intermediate transfer member to a second speed higher than the first speed during a predetermined time period.

31 Claims, 7 Drawing Sheets

IMAGE FORMING APPARATUS WITH MULTI-SPEED INTERMEDIATE TRANSFER MEMBER

BACKGROUND OF THE INVENTION

1. Field of the Invention

The present invention relates to an image forming apparatus, such as a copying machine, a printer, a facsimile apparatus. More particularly, the invention relates to an image forming apparatus that transfers images on an image bearing member to an intermediate transfer member, and then, transfers the images on the intermediate transfer member to a transfer material.

2. Related Background Art

For the conventional color image forming apparatus (a copying machine or a laser beam printer, for example), there has been known an image forming apparatus of the so-called intermediate transfer type where a plurality of toner images formed by a plurality of image forming sections, respectively, are transferred once to the intermediate transfer member sequentially to superimpose them on the intermediate transfer member, and after that, the images are transferred from the intermediate transfer member to a transfer material collectively.

FIG. 7 is a view which shows one example of the image forming apparatus described above.

As shown in FIG. 7, the apparatus is provided with the four image forming sections Pa, Pb, Pc, and Pd, and the intermediate transfer belt (intermediate transfer member) 71. For each of the image forming sections Pa, Pb, Pc, and Pd, there is provided each of photosensitive drums 101*a*, 101*b*, 10*c*, and 101*d*; charging members 102*a*, 102*b*, 102*c*, and 102*d*; exposure devices 103*a*, 103*b*, 103*c*, and 103*d*; developing devices 104*a*, 104*b*, 104*c*, and 104*d*; cleaning devices 105*a*, 105*b*, 105*c*, and 105*d*; and transfer members 106*a*, 106*b*, 106*c*, and 106*d*.

In each of the image forming sections Pa, Pb, Pc, and Pd, each of the toner images having different colors is formed by each of the members described above. The toner images thus formed are sequentially and primarily transferred to the intermediate transfer belt 71 which is passed over rollers 132 and 133 below the image forming sections Pa, Pb, Pc, and Pd to travel in the direction indicated by an arrow R71. Then, four color toner images are superimposed on top of one another on the intermediate transfer belt 71. The images thus superimposed are secondarily transferred to a transfer material P in the secondary transfer position 111 between the intermediate transfer belt 71 and a transfer roller 72. The transfer material P is supplied from a sheet feed cassette 90, in which the transfer material is stored, to the secondary transfer position 111 by registration rollers 125A and 125B and others at the timing that matches with that of the toner image on the intermediate transfer belt 71. After the transfer of the toner image, the transfer material P is discharged to the outside of the main body of the image forming apparatus by a discharge roller 145 after the toner image is fixed on the surface of the transfer material by a fixing device 140.

Generally, the color image forming apparatus described above is often required to deal with the situation where monochromatic images are output as documents or some others more than color images at offices or the like, for example. Therefore, the apparatus is arranged to be able to selectively output color images (the toner image formed by superimposing the four-color, three-color, or two-color images) and monochromatic images (the monochromatic toner image; mostly black toner images).

However, for the image forming apparatus of the intermediate transfer type as described above, there is a problem in that it takes an unnecessary amount of time to output an image monochromatically.

In other words, when the monochromatic image is outputted, the toner image formed by the photosensitive drum 101*d* of the image forming section Pd is primarily transferred to the intermediate transfer belt 71 in the primary transfer position 110, and after that, the toner image is conveyed to the secondary transfer position 111 when the intermediate transfer belt 71 is rotated almost half the one revolution in the direction indicated by the arrow R71. As a result, it takes a period of time before the toner image is conveyed to the secondary transfer position 111 from the primary transfer position 110. It takes a period of time inevitably to output an image even monochromatically.

Also, when a monochromatic image is formed by making each of the peripheral speed of the photosensitive drum, the peripheral speed of the intermediate transfer belt, and the peripheral speed of the roller pair in the fixing device faster than that when a color image is formed, there is encountered a problem in making the image forming apparatus smaller at lower costs, because in such a case, a transfer nip should be made larger in a conveying direction of a transfer material or the transfer electric current (voltage) should be made larger in order to secure the transferability, and a fixing nip should be made larger in the conveying direction of the transfer material and the fixing temperature should be set at a temperature still higher in order to secure the fixing capability of the toner image.

SUMMARY OF THE INVENTION

With a view to solving the problems discussed above, the present invention is designed. It is an object of the invention to provide an image forming apparatus capable of making the time required for forming a monochromatic toner image on a transfer material shorter in order to enhance the throughput of the image formation.

Other objectives and advantages beside those described above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 2:
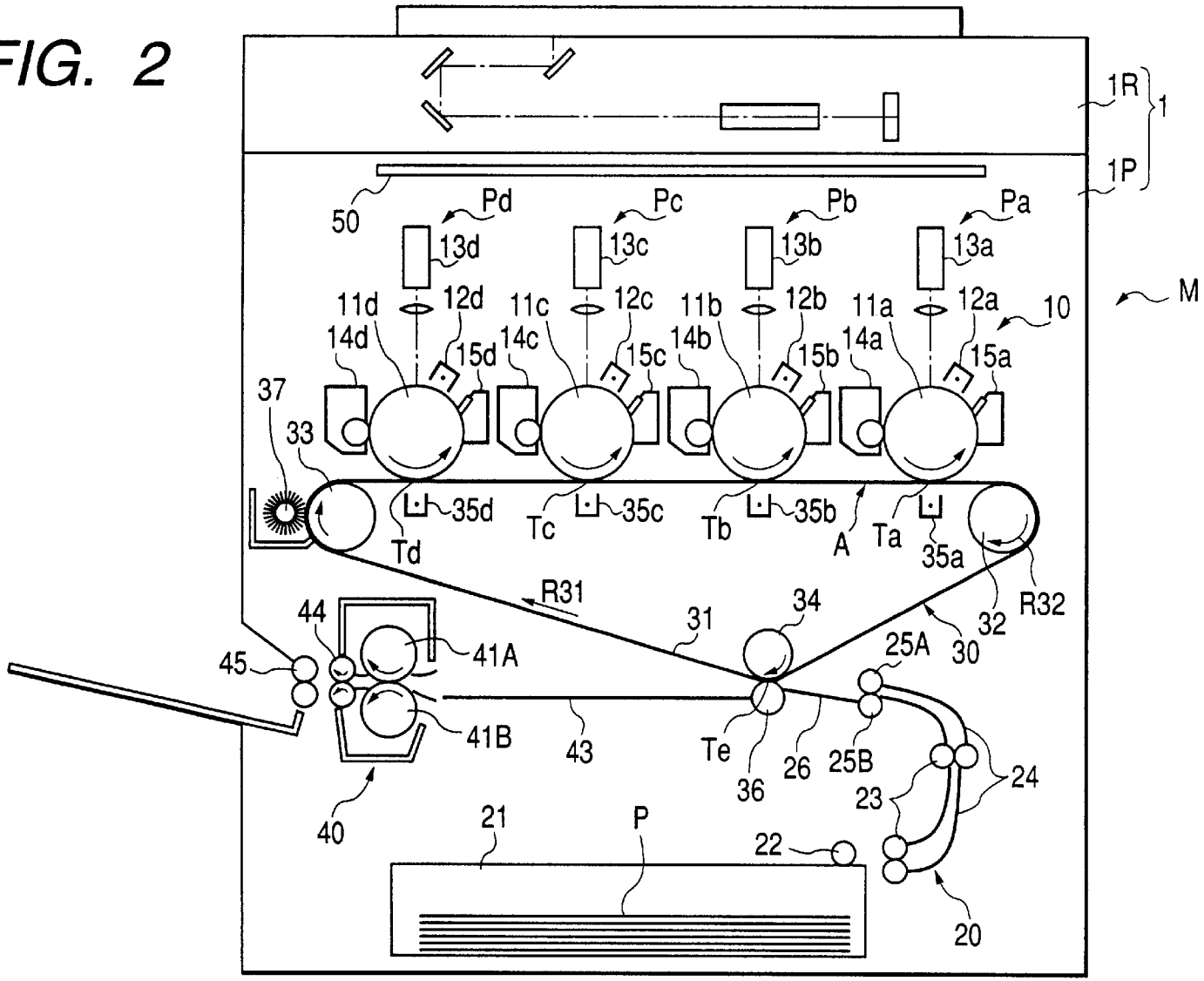
FIG. 2 is a view which schematically shows a color image forming apparatus of intermediate transfer type in accordance with the present invention.

FIG. 2 is a view which shows one example of an image forming apparatus of the present invention. Here, FIG. 2 illustrates a four-color image forming apparatus 1 of full color electrophotographic type which is provided with a plurality (four) of image forming sections.

As shown in FIG. 2, the image forming apparatus 1 comprises a printing unit 1P, and a reader unit 1R arranged above the printing unit 1P.

The printing unit 1P is provided with four image forming sections Pa, Pb, Pc, and Pd arranged in the upper part of the main body M of the image forming apparatus main body M (hereinafter, referred to as an "image forming section 10" collectively); sheet feeding means 20 arranged in the lower part; a transfer device 30 arranged between the image forming section 10 and the sheet feeding means 20; fixing means 40 arranged on the downstream side of the sheet feeding means 20 in the conveying direction of a transfer material P; and control means 50 arranged above the image forming section 10.

Now, hereunder, the detailed description will be made of the image forming section 10 to the control means 50 in that order.

The image forming section 10 (image forming sections Pa, Pb, Pc, and Pd) is provided with photosensitive drums 11*a*, 11*b*, 11*c*, and 11*d* which are the drum-shaped electrophotographic photosensitive members as image bearing members (hereinafter referred to as the "photosensitive drum"). These photosensitive drums are driven to rotate by driving means (not shown) in the direction indicated by each of the arrows (counter-clockwise). On the circumference of each of the photosensitive drums 11*a* to 11*d*, each of primary chargers (charging devices) 12*a*, 12*b*, 12*c*, and 12*d*, optical systems (exposure devices) 13*a*, 13*b*, 13*c*, and 13*d*, developing devices 14*a*, 14*b*, 14*c*, and 14*d*, and cleaning devices 15*a*, 15*b*, 15*c*, and 15*d* are arranged to face the surface of the photosensitive drums 11*a* to 11*d*, respectively. For the image forming section 10, the image forming sections Pd, Pc, Pb, and Pa are arranged from the upstream side to the downstream side in that order in the rotational direction (indicated by an arrow R31) of the intermediate transfer belt 31 which will be described later.

The primary chargers 12*a* to 12*d* are arranged to charge uniformly the surfaces of the photosensitive drums 11*a* to 11*d* with a predetermined polarity (negative polarity in the present embodiment) and a predetermined potential. Also, the optical systems 13*a* to 13*d* are arranged to form electrostatic latent images by removing the charge of each exposed portion with the laser beam or the like, for example, which has been modulated in accordance with recording image signals, and which is exposed on each of the photosensitive drums 11*a* to lid. Further, the developing devices 14*a*, 14*b*, 14*c*, and 14*d* contain black, magenta, cyan, and yellow toner in that order, and develop (visualize) the toner image by allowing each toner (toner having the negatively charged characteristic) to adhere to each electrostatic latent image on the photosensitive drums 11*a*, 11*b*, 11*c*, and 11*d*, respectively. Then, the cleaning devices 15*a*, 15*b*, 15*c*, and 15*d* are arranged to scrape off for cleaning the remaining toner (toner remaining after the primary transfer) on the photosensitive drums 11*a*, 11*b*, 11*c*, and 11*d* without being primarily transferred to the intermediate transfer belt 31 during the transfer which will be described later.

Sheet feeding means 20 comprises a sheet feed cassette 21 that stores the transfer material P, such as sheets of paper; a pickup roller 22 that sends out the transfer material P one by one from the sheet feed cassette 21; sheet feed rollers 23 that feed the transfer material P sent out from the pickup roller 22 to the registration roller which will be described later; a transfer material guides 24; registration rollers 25A and 25B that send out the transfer material P to the transfer device 30 at a timing that matches with an image formation in the image forming section 10; and a guide 26 which guides the transfer material P before a transfer.

The transfer device 30 comprises the endless intermediate transfer belt 31 which serves as the intermediate transfer member; three rollers over which the intermediate transfer belt 31 is passed, that is, a driving roller 32, a driven roller 33, and a tension roller 34; primary transfer chargers 35*a*, 35*b*, 35*c*, and 35*d* arranged opposite to the photosensitive drums 11*a*, 11*b*, 11*c*, and 11*d*, respectively; and a secondary transfer charger 36 arranged opposite to the tension roller 34.

When the toner image, which has been formed in the image forming section, is primarily transferred on the intermediate transfer belt, the primary transfer charger presses the intermediate transfer belt 31 from below so as to urge the intermediate transfer belt 31 against the image forming section. When the primary transfer is not performed, the pressure is released so that the intermediate transfer belt 31 is usually a part from each of the image forming sections by approximately 0.1 to 1 mm.

For the material of the intermediate transfer belt 31, PET (polyethylene terephthalate), PVdF (polyvinyliden fluoride), or the like is used, for example. The transfer belt 31 forms a primary transfer plane A at a place between the driving roller 32 and the driven roller 33 of the three rollers described above. The driving roller 32 is a metallic roller on which a rubber (urethane or chroroprene) having a thickness of several millimeters is coated in order to avoid slipping between this roller and the intermediate transfer roller 31. The driving roller 32 is driven to rotate by a pulse motor (not shown). The tension roller 34 is structured to provide an appropriate tension for the intermediate transfer belt 31. The intermediate transfer belt 31 rotates (goes a round) in the direction indicated by the arrow R31 by the rotation of the driving roller 32 that rotates in the direction indicated by the arrow R32. For each of the primary transfer positions Ta, Tb, Tc, and Td in that each of the photosensitive drums 11*a*, 11*b*, 11*c*, and 11*d* is opposed to the intermediate transfer belt 31, each of the primary transfer chargers 35*a*, 35*b*, 35*c*, and 35*d* is arranged on the back surface side of the intermediate transfer belt 31. The secondary transfer roller 36 is arranged opposite to the tension roller 34, and then, the secondary transfer position Te is defined by a nip between the secondary transfer roller 36 and the intermediate transfer belt 31. Also, on the downstream of the secondary transfer position Te in the rotational direction of the intermediate transfer belt 31, a brush roller 37 is arranged to clean the surface of the intermediate transfer belt 31 by removing the toner (toner remaining after the secondary transfer) remaining on the intermediate transfer belt 31, which has not been transferred to the transfer material P, but remains on the surface thereof at the time of the secondary transfer. The fixing means 40 is provided with a fixing roller 41A having a heat source such as halogen heater in it; a pressure roller 41B (in some cases, a heat source may be installed in the pressure roller 41B), which presses the fixing roller 41A; a conveying guide 43 to guide the transfer material P to the nip between these rollers; and internal sheet discharge rollers 44 and external sheet discharge rollers 45 to discharge the transfer material P, which has been conveyed by these rollers 41A, 41B, to the outside of the main body M of the image forming apparatus.

The control means 50 is provided with a control substrate for controlling the operation of the devices and members that constitute each of the means described above, and also, with a motor drive substrate (not shown).

Now, the description will be made of the operation of the image forming apparatus structured as described above.

When the image forming operation initiation signal is inputted by a user or from a host computer, a PC or the like, the pickup roller 22 sends out at first the transfer material P one by one from the sheet feed cassette 21. Then, the transfer material P is guided by the sheet feed roller 23 between the sheet feed guides 24 and fed to the registration rollers 25A and 25B. At this juncture, the registration roller 25A and 25B are stationary, and the leading end of the transfer material P abuts against the nip portion of these rollers. After that, the registration rollers 25A and 25B begin to rotate at the timing that matches with the timing of the image forming section 10 to initiate the image formation. The timing of this rotation is set so that the toner image which has been primarily transferred to the intermediate transfer belt 31 from the image forming section 10, and the transfer material P are allowed to meet in the secondary transfer position Te exactly.

On the other hand, when the initiating signal is issued to operate the image formation in the image forming section 10, the yellow toner image, which has been formed on the photosensitive drum 11*d* by the image forming process such as the charging, exposure, developing, and others as described earlier on the upstreammost image forming section Pd, is primarily transferred to the intermediate transfer belt 31 by the primary transfer charger 35*d* to which high voltage (positive voltage in the present embodiment) is applied in the primary transfer position Td. The yellow toner image thus primarily transferred is conveyed by the rotation of the intermediate transfer belt 31 to the primary transfer position Tc on the downstream next image forming section Pc, where the cyan toner image is transferred. In the image forming section Pc, since the image is formed with the delay corresponding to the time required for conveying the yellow toner image from the image forming section Pd on the upstream side, the next cyan toner image is positioned and transferred in superposition on the yellow toner image that has been transferred in the image forming section Pd. Then, in the image forming sections Pb and Pa further on the downstream side, the same process is repeated. In this manner, the toner images each having different color, which are formed on the intermediate transfer belt 31 in the image forming sections Pd, Pc, Pb, and Pa, respectively, are primarily transferred in the primary transfer positions Td, Tc, Tb, and Ta sequentially to superpose the four-full color toner images (the toner images of plural colors) on top of one another after all.

Subsequently, then, when the transfer material P enters the second transfer position Te so as to be in contact with the intermediate transfer belt 31, the secondary transfer roller 36 moves to nip the transfer material P between the intermediate transfer belt 31 and the secondary transfer roller 36 at the timing that matches with the passage timing of the transfer material P, and high voltage (positive voltage in the present embodiment) is applied to the secondary transfer roller 36. In this manner, the four-color toner images on the intermediate transfer belt 31 are secondarily transferred to the surface of the transfer material P collectively.

After the secondary transfer, the transfer material P is guided exactly by the conveying guide 43 to a nip between the fixing roller 41A and the pressure roller 41B of the fixing means 40, where the transfer material P is heated and pressed. Thus, the four-color toner images are fused and fixed to produce a fixed color image on the surface of the transfer material P. After the toner image fixation, the transfer material P is conveyed by the internal sheet discharge rollers 44 and the external sheet discharge rollers 45 to be discharged outside the main body M of the image forming apparatus, hence completing the formation of the four-full color image. In this respect, the residual toner after the primary transfer, which remains on the surface of the photosensitive drums 11*d*, 11*c*, 11*b*, and 11*a* after the toner images are primarily transferred, is removed by the cleaning devices 15*d*, 15*c*, 15*b*, and 15*a*, respectively, and also, the residual toner after the secondary transfer, which remains on the intermediate transfer belt 31 after to the toner images are secondarily transferred, is removed by brush roller 37.

Also, for the image forming apparatus of the present embodiment, the structure is arranged so that the full color mode described above, and the monochromatic mode (to form a black toner image in the present embodiment) are made switchable by use of the control means 50.

Figure 1:
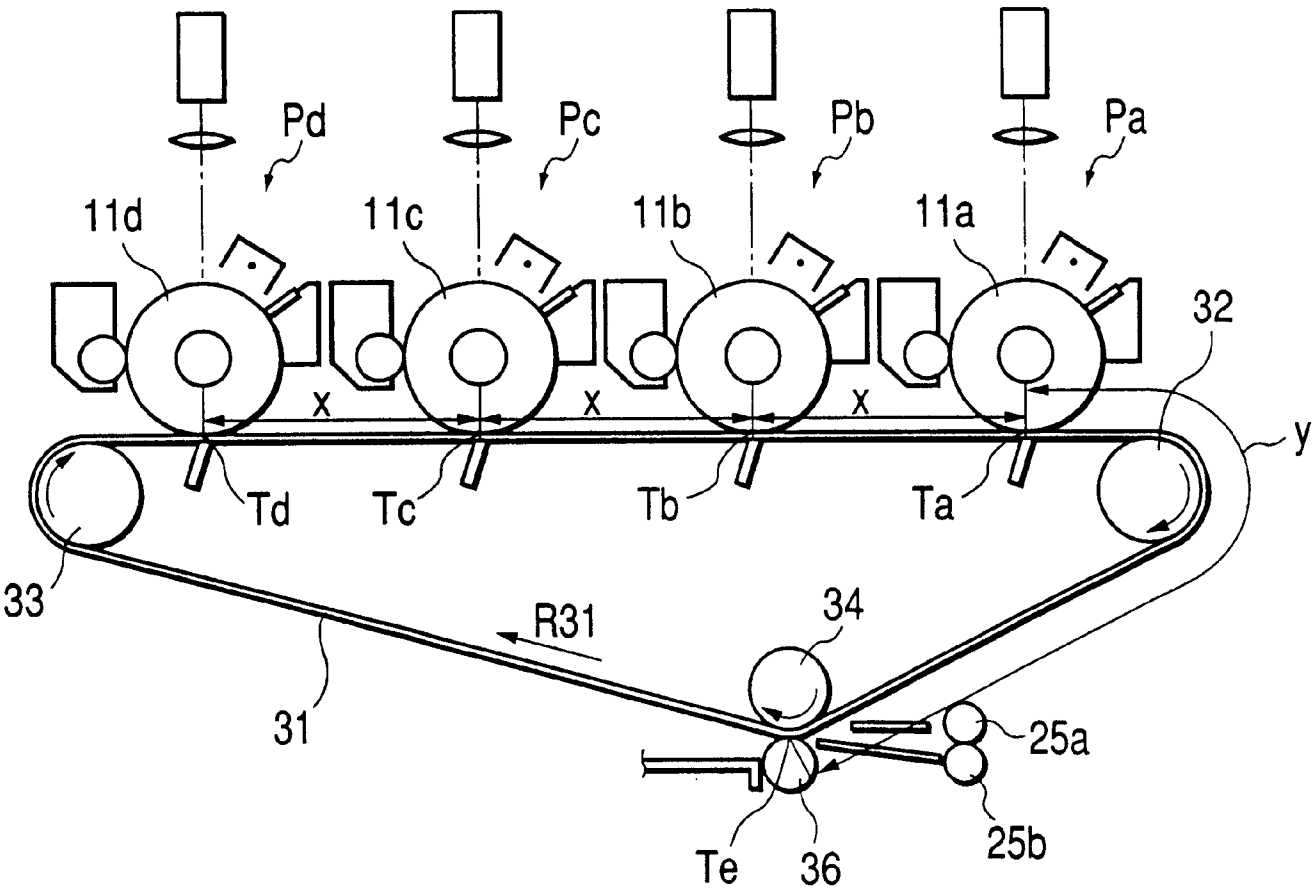
FIG. 1 is a view which schematically shows an image forming section and a circumference of an intermediate transfer unit in accordance with the present invention.

Now, with reference to FIG. 1, the detailed description will be made of the characteristic part of the present invention. FIG. 1 is a view which shows only the part needed for the illustration here from among those represented in FIG. 2.

In FIG. 1, among the image forming sections Pa, Pb, Pc, and Pd, the image forming section Pa, which is positioned in the downstreammost side in the rotational direction (the direction indicated by the arrow R31) of the intermediate transfer belt 31, is the one whereby to form the black toner image. Then, the distance from the primary transfer position Ta, which is the contact point of the image forming section Pa and the intermediate transfer belt 31, to the secondary transfer position Te is shorter than the distances from any other primary transfer positions Tb to Td, which are the respective contact points of the other image forming sections Pb to Pd and the intermediate transfer belt 31, to the secondary transfer position Te. To describe more specifically, given the distance between the primary transfer positions (between Ta and Tb, Tb and Tc, and Tc and Td, respectively) as x mm, and the distance from the primary transfer position Ta to the secondary transfer position Te as y mm, a distance Ld between the Td and the Te in the rotational direction of the intermediate transfer belt 31 becomes $Ld=3x+y$. Likewise, a distance Lc between the Tc and the Te becomes $Lc=2x+y$, and a distance Lb between the Tb and the Te becomes $Lb=x+y$. Here, given a rotational speed v of the intermediate transfer belt 31 as 100 mm/sec, a toner image which has been transferred at the primary transfer position Ta arrives at the secondary transfer position Te in y/100 sec. On the other hand, a toner image transferred in the primary transfer position Td arrives at the secondary transfer position Te in (3x+y)/100 sec. Therefore, if the x=100 mm, there is a difference of 3 seconds. Here, there are time differences of 2 seconds and 1 second for the toner images which are transferred in the primary transfer positions Tc and Tb, respectively.

Therefore, it is possible to make the output time of the black monochromatic toner image shorter by forming the black toner image in the image forming section Pa, which is nearest to the secondary transfer position Te in the rotational direction of the intermediate transfer belt 31, than by forming it in any one of the other image forming sections Pb, Pc and Pd as described for the present embodiment.

Since each of the image forming sections Pa to Pd is provided with each independent photosensitive drums 11*a* to 11*d*, it is possible to suspend the operation of the image forming sections other than the one needed for outputting a particular color when a monochromatic image is output so as to release the pressure exerted by the primary transfer chargers and enable such photosensitive drums to part from the intermediate transfer belt. In this manner, the life of the photosensitive drums can be made longer. Also, with each of the image forming sections Pa to Pd provided with each of the photosensitive drums 11*a* to 11*d* individually, it may be possible to replace only the photosensitive drum which needs its replacement when any one of the photosensitive drums 11*a* to 11*d* should be replaced due to the service life or the like. This arrangement is economical.

Figure 4:
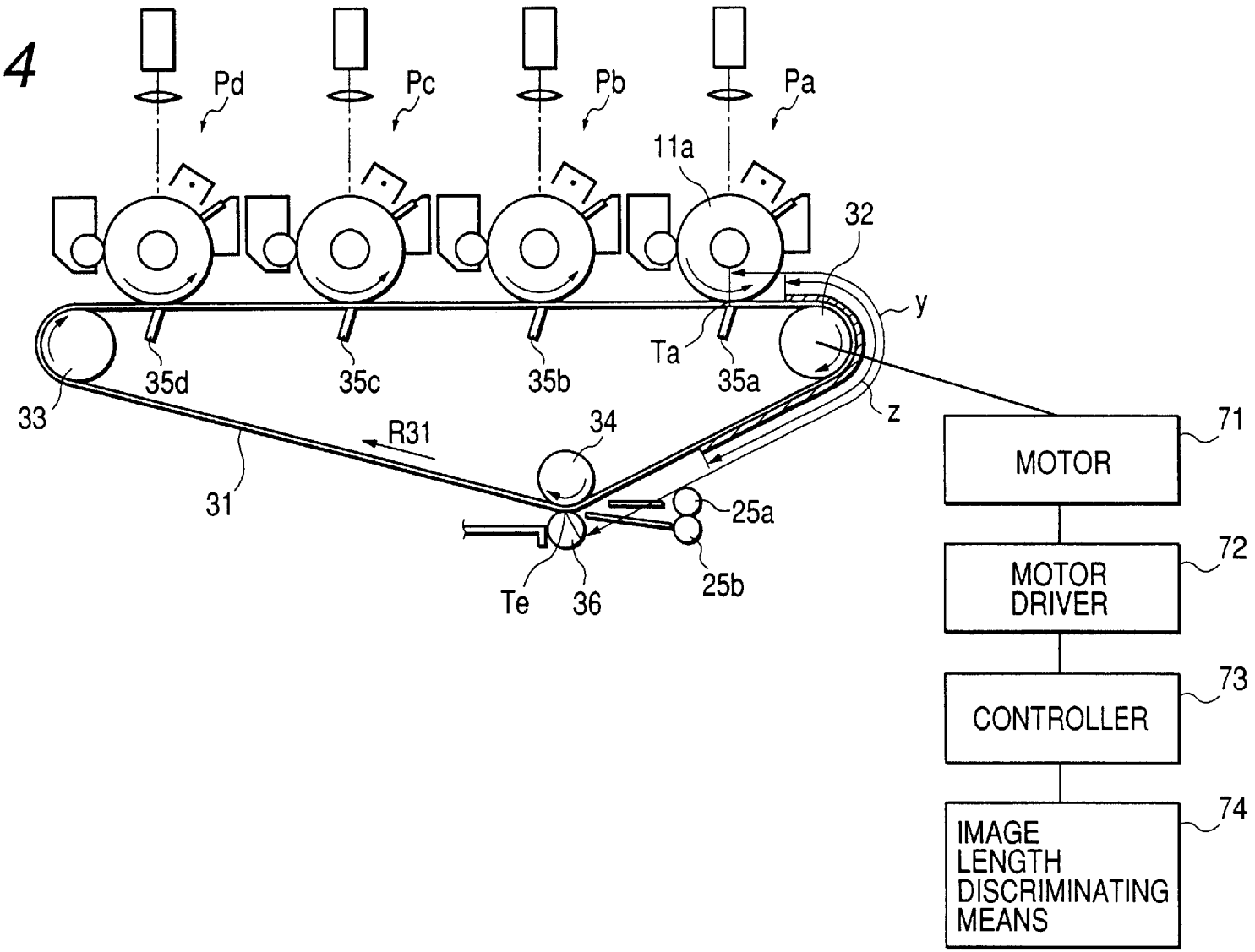
FIG. 4 is a view which schematically shows a characteristic portion of an image forming section and a circumference of an intermediate transfer unit in accordance with the present invention.

Also, for the image forming apparatus shown in FIG. 4, the structure is arranged so that the black toner image can be formed on the image forming section Pa which is positioned on the downstreammost in the rotational direction (the direction indicated by the arrow R31) of the intermediate transfer belt 31 among the image forming sections Pa, Pb, Pc, and Pd.

Now, the description will be made of the characteristic part of the present embodiment. In the case of the toner image transferred to the postcard-sized transfer material or the one smaller than the A4 size, where the image length is shorter than the distance from the primary transfer position Ta to the secondary transfer position Te, when a trailing end of the toner image formed by the photosensitive drum 11*a* is completed to be primarily transferred on the intermediate transfer belt 31 a complete signal is transmitted to the controller 73. Then, the controller 73 issues the instruction to the motor driver 72 to make the rotating speed (r.p.m.) of the motor 71 higher for a predetermined period of time, that is, the period during which a leading end of the toner image arrives at the secondary transfer position Te. As a result, the toner image thus primarily transferred is moved to the secondary transfer position Te at a higher speed than the process speed (that is, the peripheral speed of the intermediate transfer belt when the toner image is t transferred from the photosensitive drum to the intermediate transfer belt), which is 1.5 to 2 times higher than the process speed, for example. Therefore, an output time of the monochromatic image can be reduced for that.

Also, image length discriminating means 74 may be provided for discriminating a relationship between a length of the toner image in the moving (rotational) direction of the intermediate transfer belt and the distance between the Ta and the Te.

Now, the description will be made of the control that uses the image length discriminating means 74.

With the image length discriminating means 74, it is discriminated whether or not the following formula is satisfied as the relationship between the image length z to be output and the distance y from the primary transfer position to the secondary transfer position:

$$y>z$$

If this relationship is satisfied, the instruction is issued from the image length discriminating means 74 to the controller 73 so as to make the rotating speed of the intermediate transfer belt 31 higher. After the controller 73 receives the instruction from the image length discriminating means 74 to make the rotating speed of the intermediate transfer belt 31 higher, and after the controller 73 receives the complete signal which indicates that the primary transfer is completed on the intermediate transfer belt 31 for the toner image formed by the photosensitive drum 11*a*, the controller 73 instructs the motor driver 72 to make the rotating speed of the motor 71 higher during a predetermined period of time (during which the toner image arrives at the secondary transfer position). On the other hand, the pressure exerted by the primary transfer charger 35*a* on the intermediate transfer belt 31 and the image forming section Pa is released at the primary transfer position Ta immediately after the completion of the primary transfer. Thus, the intermediate transfer belt 31 is allowed to part from the image forming section Pa, and rotate at a high speed brought about by the increased rotating speed of the motor 71.

Therefore, the primarily transferred toner image moves at a speed higher than the process speed (1.5 to 2 times the process speed, for example) to the second transfer position, hence making it possible to shorten the time required for outputting the monochromatic image. The aforesaid image length discriminating means 74 may be arranged to serve its function in accordance with the size information of a transfer material on which the image output is transferred set automatically or set manually by the user.

Figure 5:
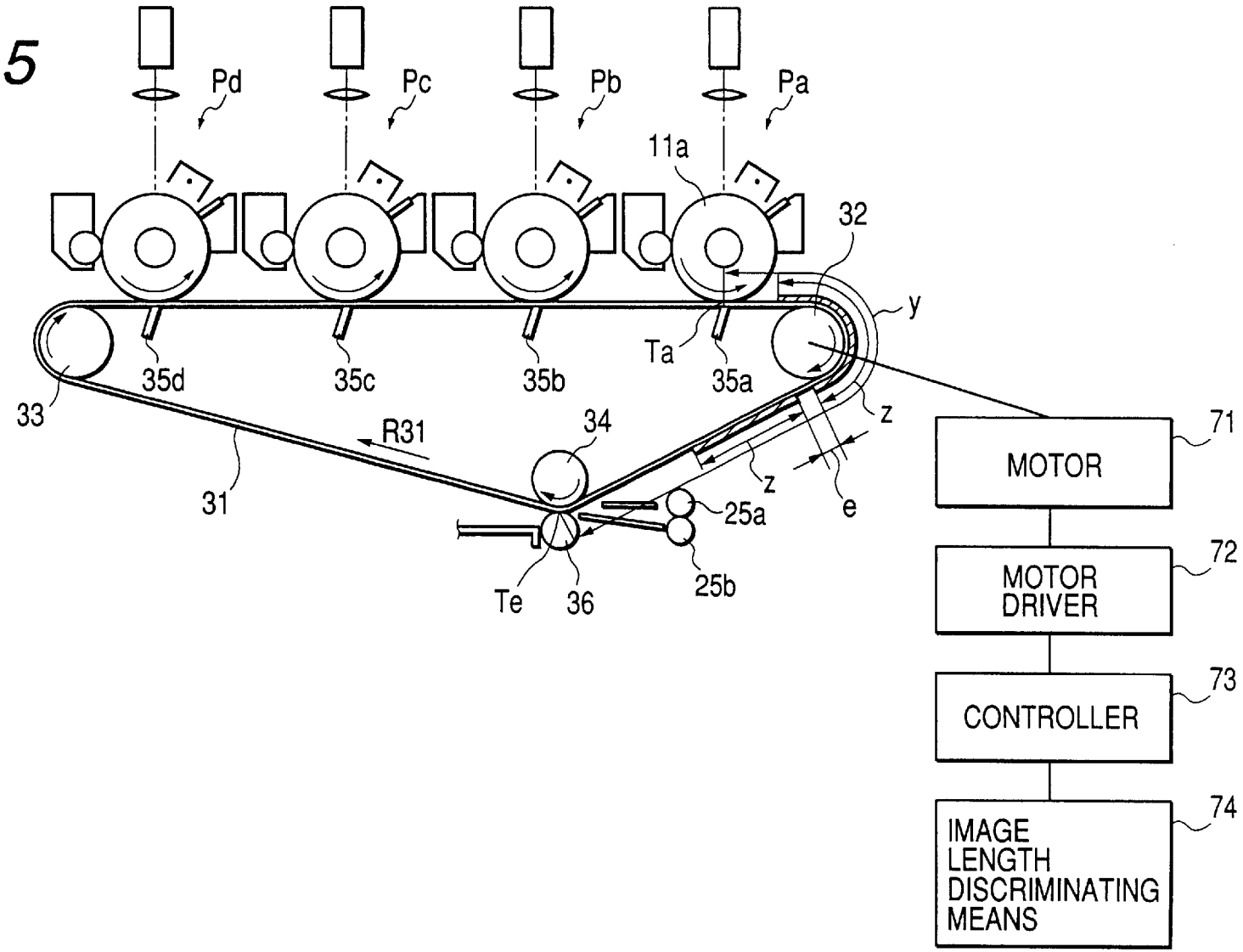
FIG. 5 is a view which schematically shows a characteristic portion of an image forming section and a circumference of an intermediate transfer unit in accordance with the present invention.

Also, as shown in FIG. 5, when a plurality of images are continuously outputted, the image length discriminating means 74 discriminates whether or not the following formula is satisfied:

$$y>nz+(n-1)e$$

where the z is the image length per sheet to be output; the y is the distance from the primary transfer position to the secondary transfer position; the e is a distance between images on the intermediate transfer belt 31; and the n is the number of sheets to be output. Then, if this relationship is satisfied, an instruction is issued from the image length discriminating means 74 to the controller 73 to make the rotating speed of the intermediate transfer belt 31 higher. After the controller 73 receives the instruction from the image length discriminating means 74 to make the rotating speed of the intermediate transfer belt 31 higher, and after the controller 73 receives the complete signal which indicates that the primary transfer is completed on the intermediate transfer belt 31 for the toner image formed by the photosensitive drum 11*a*, the controller 73 instructs the motor driver 72 to make the rotating speed of the motor 71 higher during a predetermined period of time (during which the toner image arrives at the secondary transfer position). Therefore, even at the time of outputting images continuously, the primarily transferred toner image can move to the secondary transfer position at a speed higher than the process speed (1.5 to 2 times the process speed, for example) if the image length z is shorter, hence making it possible to shorten the time required for outputting the monochromatic image.

In other words, in accordance with the present embodiment in the case where a monochromatic image is formed, it is unnecessary to make a peripheral speed of the photosensitive drum and a peripheral speed of the roller pair of the fixing device higher than the case where a color image is formed. Consequently, not only is it possible to make the image forming apparatus smaller at lower costs of manufacture, but also, it is possible to reduce the time period between a time when an image forming initiation signal is inputted to the controller and a time when the transfer material having a monochromatic image formed on it is discharged outside the apparatus.

Also, when the peripheral speed of the intermediate transfer belt 31 is made higher, that is, during the period between a time when the primary transfer of the monochromatic toner image is completed and a time before when the second transfer is started, it may be possible to allow the photosensitive drum 11*a* and the intermediate transfer belt 31 to part from each other by releasing the pressure exerted by the primary transfer charger 35*a*. With the structure thus arranged, it becomes possible to prevent the durability of the photosensitive drum 11*a* from being lowered due to its rubbing with the intermediate transfer belt 31 with the difference in the relative speeds.

Also, for the present embodiment, the description has been made of the case where the toner image is formed in the monochromatic mode (that is, the formation of the black toner image) in the image forming section Pa, the present invention is not necessarily limited thereto. The structure may be arranged so that a monochromatically formed toner image is produced in another image forming section, such as the section Pb, Pc, or Pd, and then, the peripheral speed of the intermediate transfer belt 31 is made higher after the primary transfer and until the beginning of the secondary transfer. In this manner, the time required for forming the image can be shortened. However, it is of course most preferable to arrange the structure so that the toner image should be formed in the monochromatic mode in the image forming section Pa.

(Second Embodiment)

Figure 3:
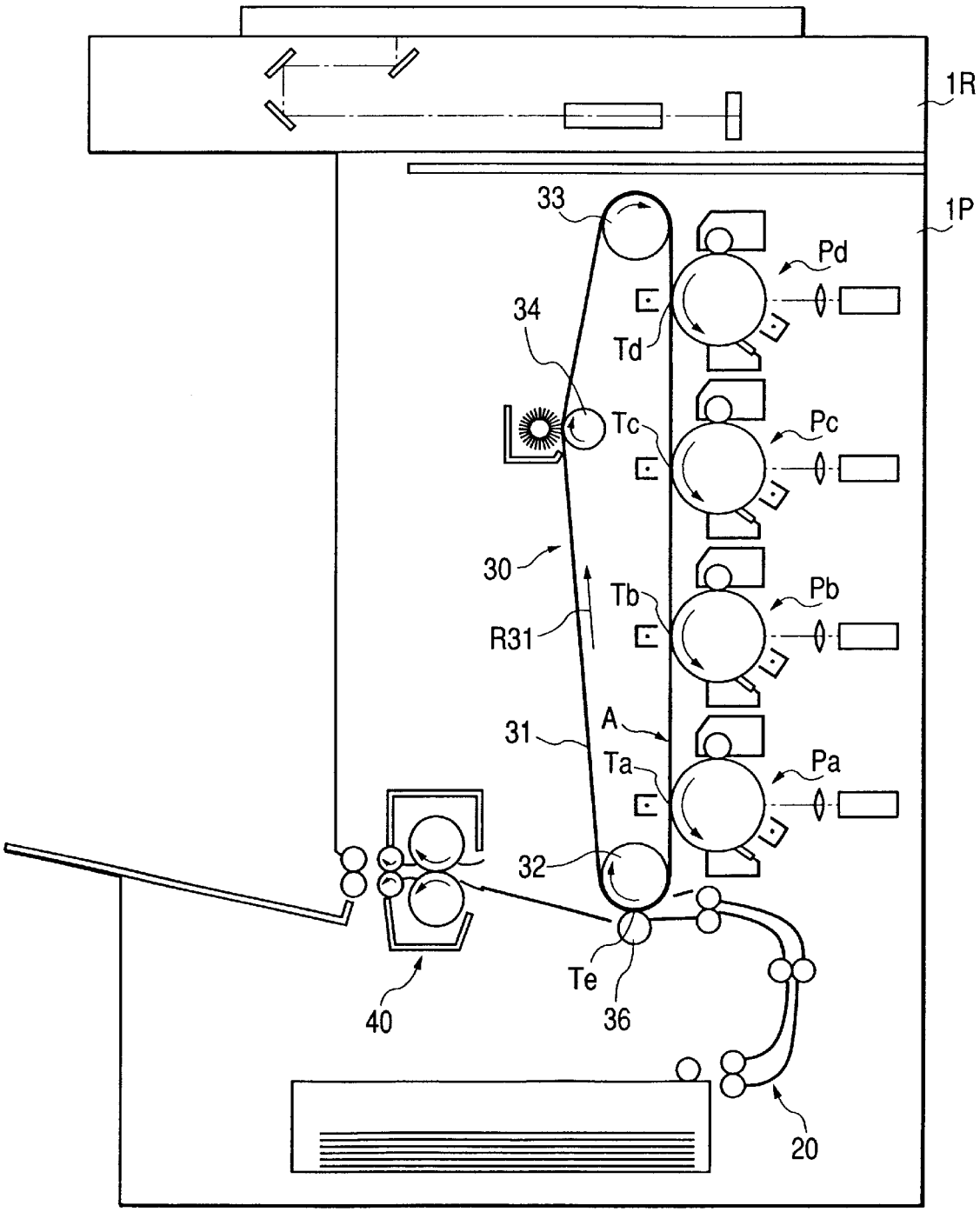
FIG. 3 is a view which schematically shows a color image forming apparatus of intermediate transfer type in accordance with the present invention.

FIG. 3 is a view which shows the characteristic part of a second embodiment in accordance with the present invention. With the exception of the features described as given below, the image forming apparatus is the same as the one described for the first embodiment, and the description thereof will be omitted. The image forming apparatus shown in FIG. 3 is structured to drive the intermediate transfer belt 31 to rotate by being passed over the driving roller 32, the driven roller 33, and the tension roller 34. The characteristic part of the present embodiment is that the secondary transfer position Te is defined by the driving roller 32 and the secondary transfer roller 36, which driving roller 32 is on the downstream side of the first transfer surface A formed by a position of the intermediate transfer belt 31 positioned between the driving roller 32 and the driven roller 33. Also, in FIG. 3, the primary transfer surface A of the intermediate transfer belt 31 substantially extends in the vertical direction. More specifically, the secondary transfer position Te is defined between the position of the intermediate transfer belt 31 which passed over the driving roller 32, and the secondary transfer roller 36. Then, as in the first embodiment, it is arranged to form the black toner image in the image forming section Pa which is the nearest to the secondary transfer position Te. Therefore, in accordance with the second embodiment, the distance between the primary transfer position Ta and the secondary transfer position Te is made shorter than the first embodiment. Hence, the time can be shortened still more for outputting a monochromatic image.

(Third Embodiment)

Figure 6:
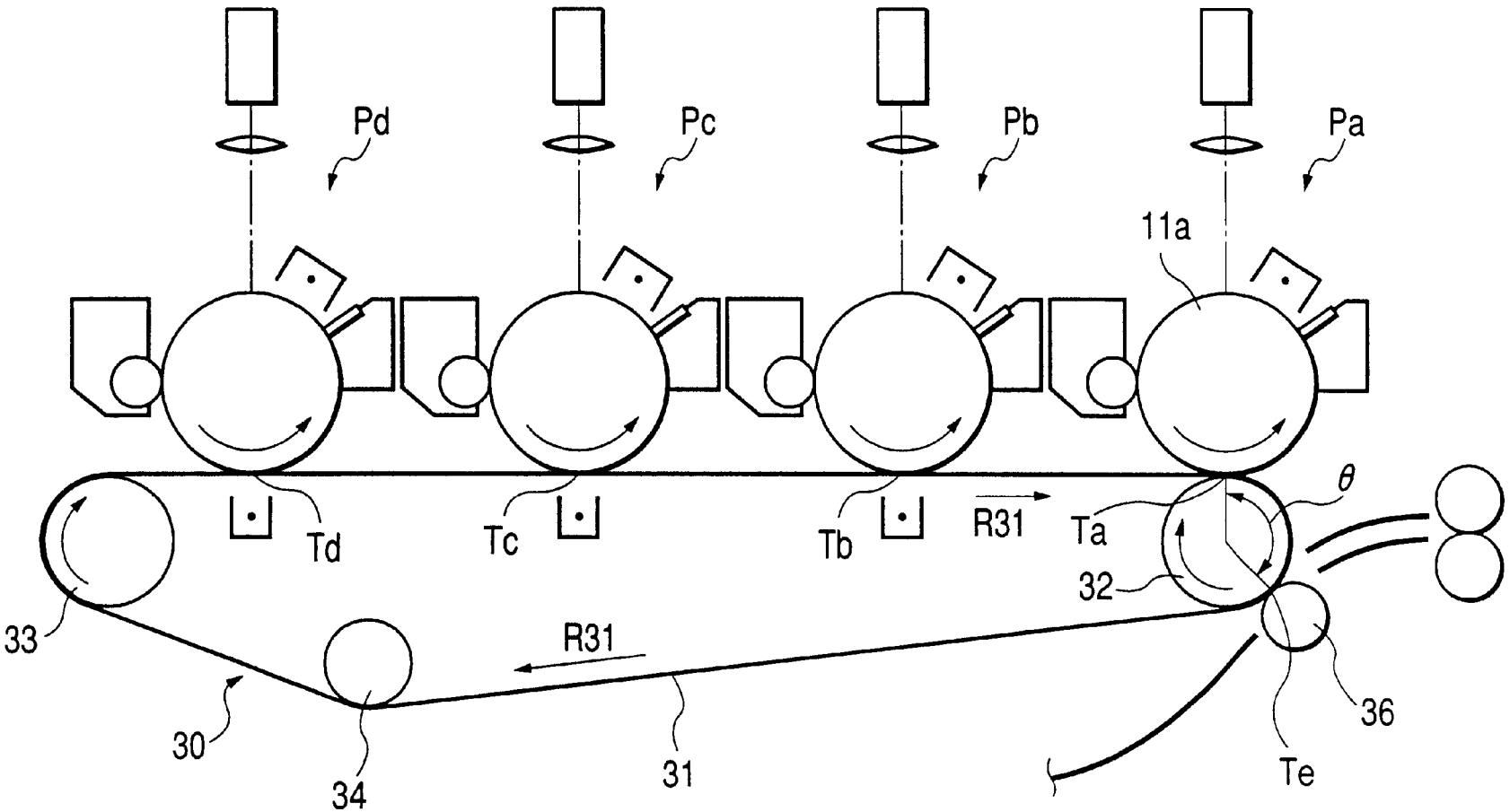
FIG. 6 is a view which schematically shows a characteristic portion of an image forming section and a circumference of an intermediate transfer unit in accordance with the present invention.
Figure 7:
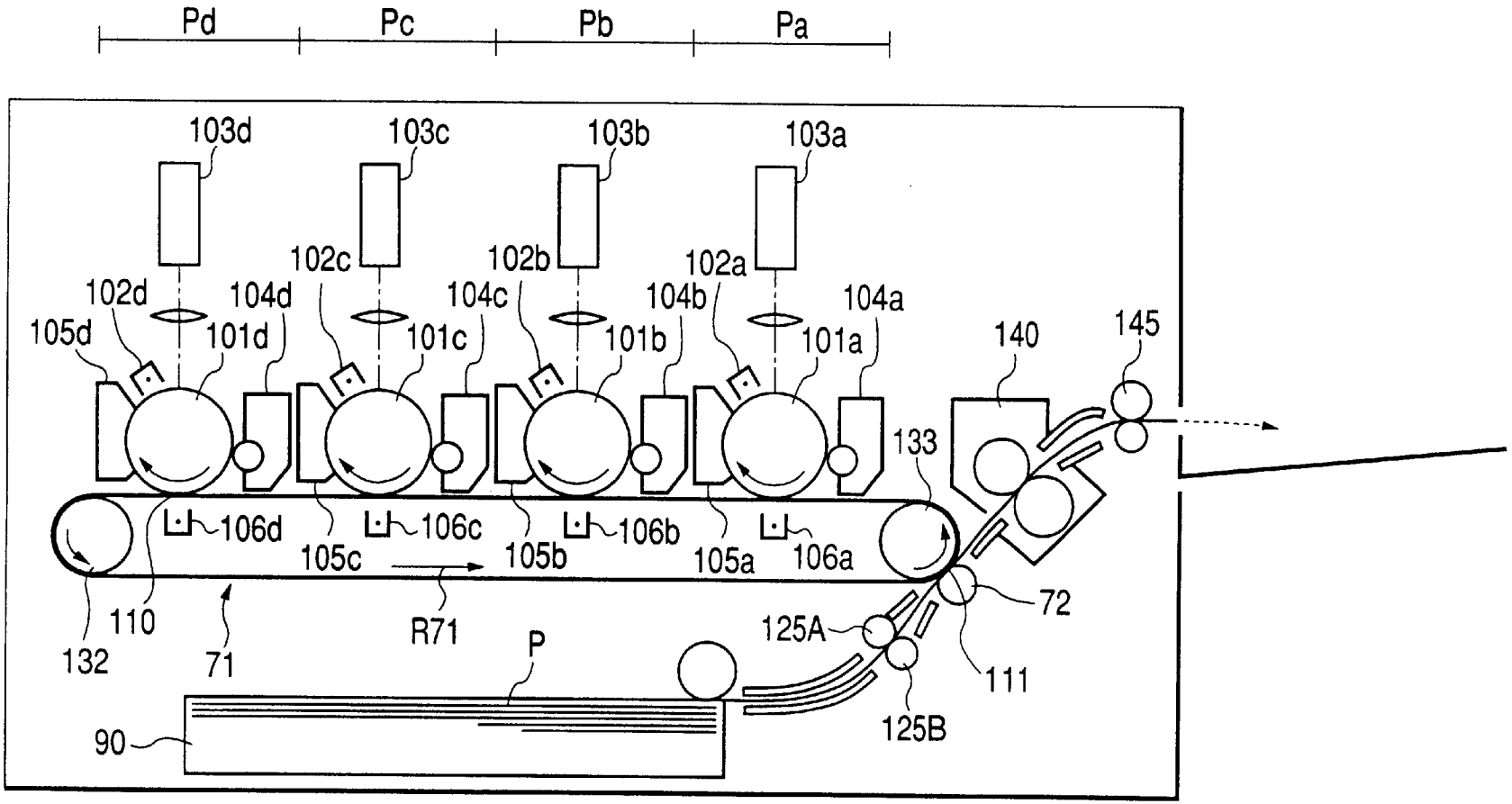
FIG. 7 is a view which schematically shows a conventional color image forming apparatus of intermediate transfer type.

FIG. 6 is a view which shows a third embodiment in accordance with the present embodiment. With the exception of the features described as given below, the image forming apparatus is the same as the one described for the first embodiment, and the description thereof will be omitted. In accordance with the image forming apparatus shown in FIG. 6, the image forming section Pa of the image forming sections Pa, Pb, Pc, and Pd, which is positioned on the downstreammost side in the rotational direction (the direction indicated by the arrow R31) of the intermediate transfer belt 31, forms the black toner image. Further, the intermediate transfer belt 31 is passed over the driving roller 32, the tension roller 33, and the driven roller 34. The diameter of the driving roller 32 is smaller than that of the photosensitive drum 11*a*, and also, high voltage current is applied to the driving roller 32 so that the driving roller 32 serves as the transfer roller opposite to the image forming section Pa with the transfer belt 31 interposed therebetween to define the primary transfer position Ta. Further, the driving roller 32 is opposite to the secondary transfer roller 36 with the intermediate transfer belt 31 interposed therebetween to define the secondary transfer position Te. In this case, it is desirable to set the angle θ formed by the first transfer position Ta and the second transfer position Te at 90° to 180°. Therefore, when a monochromatic image is output, it becomes possible to perform the secondary transfer in the secondary transfer position Te which is positioned on the circumference of the driving roller 32 after the first transfer has been performed in the primary transfer position Ta.

In accordance with the present embodiment, since the primary transfer position Ta and the secondary transfer position Te that form a monochromatic image are positioned on the circumference of the same roller, it becomes possible to shorten the time required for outputting the monochromatic image significantly. Further, the driving roller 32 that supports the intermediate transfer belt 31 serves as the primary transfer roller and the opposed roller to the secondary transfer roller. As a result, the number of parts becomes smaller to implement the costs reduction accordingly.

In accordance with the first to third embodiments described above, the description has been made of the case where the intermediate transfer member 31 is of the intermediate transfer belt type. However, the present invention is not necessarily limited to such belt type. The invention is also applicable to the intermediate transfer member of drum type. Also, for the primary transfer charger, the description has been made of the case where the blade type or corona type charger is adopted. However, the invention is not necessarily limited to the charger of such type. It may be possible to adopt the one in the form of brush or roller. Also, for the secondary transfer charger, the description has been made of the case where the roller type charger is adopted. The invention is not necessarily limited to such type. It may be possible to adopt a secondary transfer charger in the form of a brush, blade, or corona type charger.

What is claimed is:

1. An image forming apparatus comprising:

a plurality of image bearing members for bearing images of plural colors, respectively;

an intermediate transfer member; and control means for controlling a peripheral speed of said intermediate transfer member, wherein a first mode in which the images of plural colors are sequentially transferred onto said intermediate transfer member by use of said plurality of image bearing members and the images of plural colors on said intermediate transfer member are transferred to a transfer material and a second mode in which a monochromatic image is transferred onto said intermediate transfer member by use of a predetermined image bearing member among said plurality of image bearing members and the monochromatic image on said intermediate transfer member is transferred to a transfer material are selectable, and wherein when said second mode is selected and when a length of the monochromatic image along a moving direction of said intermediate transfer member is shorter than a distance along the moving direction of said intermediate transfer member from a first position in which the monochromatic image on said predetermined image bearing member is transferred onto said intermediate transfer member to a second position in which the monochromatic image on said intermediate transfer member is transferred to the transfer material said control means switches the peripheral speed of said intermediate transfer member from a first speed at which the monochromatic image is transferred from said image bearing member to said intermediate transfer member to a second speed higher than said first speed during a time period between a time when a transfer of a trailing end of the monochromatic image from said predetermined image bearing member to said intermediate transfer member is completed and a time before a leading end of the monochromatic image on said intermediate transfer member arrives at said second position.

2. An image forming apparatus according to claim 1, wherein the distance from said first position to said second position along the moving direction of said intermediate transfer member is shorter than a distance along the moving direction of said intermediate transfer member from a third position in which an image from an image bearing member other than said predetermined image bearing member is transferred to said intermediate transfer member to said second position.

3. An image forming apparatus according to claim 1, wherein when said first mode is selected, an image of a final color is transferred from said predetermined image bearing member to said intermediate transfer member.

4. An image forming apparatus according to claims 1, 2, or 3, further comprising discriminating means for discriminating whether the length of the monochromatic image along the moving direction of said intermediate transfer member is shorter the distance from said first position to said second position along the moving direction of said intermediate transfer member.

5. An image forming apparatus according to claim 4, wherein when said second mode is selected and when said discriminating means discriminates that the length of the monochromatic image along the moving direction of said intermediate transfer member is shorter than the distance from said first position to said second position along the moving direction of said intermediate transfer member, said control means switches the peripheral speed of said intermediate transfer member from said first speed to said second speed during said time period.

6. An image forming apparatus according to claim 4, wherein when said second mode is selected and when said discriminating means discriminates that the length of the monochromatic image along the moving direction of said intermediate transfer member is equal to or longer than the distance from said first position to said second position along the moving direction of said intermediate transfer member, said control means maintains the peripheral speed of said intermediate transfer member at said first speed without change during said time period.

7. An image forming apparatus according to claims 1, 2, or 3, further comprising discriminating means for discriminating whether a length of the transfer material along a conveying direction is shorter than the distance from said first position to said second position along the moving direction of said intermediate transfer member.

8. An image forming apparatus according to claim 7, wherein when said second mode is selected and when said discriminating means discriminates that the length of the transfer material along the conveying direction is shorter than the distance from said first position to said second position along the moving direction of said intermediate transfer member, said control means switches the peripheral speed of said intermediate transfer member from said first speed to said second speed during said time period.

9. An image forming apparatus according to claim 7, wherein when said second mode is selected and when said discriminating means discriminates that the length of the transfer material along the conveying direction is equal to or longer than the distance from said first position to said second position along the moving direction of said intermediate transfer member, said control means maintains the peripheral speed of said intermediate transfer member at said first speed without change during said time period.

10. An image forming apparatus according to claim 1, wherein said intermediate transfer member is in a shape of a belt.

11. An image forming apparatus according to claim 10, further comprising a plurality of supporting rollers for supporting said intermediate transfer member.

12. An image forming apparatus according to claim 11, wherein the monochromatic image on said predetermined image bearing member is transferred on a peripheral surface of an intermediate transfer member wound around one of said plurality of supporting rollers.

13. An image forming apparatus according to claim 12, wherein the monochromatic image on said intermediate transfer member is transferred to the transfer material on said peripheral surface.

14. An image forming apparatus according to claim 1, wherein when said second mode is selected, an image bearing member other than said predetermined image bearing member is apart from said intermediate transfer member.

15. An image forming apparatus according to claim 14, wherein said predetermined image bearing member is apart from said intermediate transfer member during said time period.

16. An image forming apparatus according to claim 1, wherein a peripheral speed of said predetermined image bearing member when said first mode is selected is the same as a peripheral speed of said predetermined image bearing member when said second mode is selected.

17. An image forming apparatus according to claim 1, further comprising fixing means for fixing an image to the transfer material after the image is transferred from said intermediate transfer member to the transfer material, wherein a conveying speed of the transfer material conveyed by said fixing means when said first mode is selected is the same as a conveying speed of the transfer material conveyed by said fixing means when said second mode is selected.

18. An image forming apparatus comprising:

a plurality of image bearing members for bearing images of plural colors, respectively;

an intermediate transfer member; and control means for controlling a peripheral speed of said intermediate transfer member, wherein a first mode in which the images of plural colors are sequentially transferred onto said intermediate transfer member by use of said plurality of image bearing members and the images of plural colors on said intermediate transfer member are transferred to a transfer material and a second mode in which a monochromatic image is transferred onto said intermediate transfer member by use of a predetermined image bearing member among said plurality of image bearing members and the monochromatic image on said intermediate transfer member is transferred to a transfer material are selectable, and wherein when said second mode is selected and a length of a transfer material along a conveying direction is shorter than a distance along the moving direction of said intermediate transfer member from a first position in which the monochromatic image on said predetermined image bearing member is transferred onto said intermediate transfer member to a second position in which the monochromatic image on said intermediate transfer member is transferred to the transfer material, said control means switches the peripheral speed of said intermediate transfer member from a first speed at which the monochromatic image is transferred from said image bearing member to said intermediate transfer member to a second speed higher than said first speed during a time period between a time when a transfer of a trailing end of the monochromatic image from said predetermined image bearing member to said intermediate transfer member is completed and a time before a leading end of the monochromatic image on said intermediate transfer member arrives at said second position.

19. An image forming apparatus according to claim 18, wherein the distance from said first position to said second position along the moving direction of said intermediate transfer member is shorter than a distance along the moving direction of said intermediate transfer member from a third position in which an image from an image bearing member other than said predetermined image bearing member is transferred to said intermediate transfer member to said second position.

20. An image forming apparatus according to claim 18, wherein when said first mode is selected, an image of a final color is transferred from said predetermined image bearing member to said intermediate transfer member.

21. An image forming apparatus according to claims 18, 17, or 18, further comprising discriminating means for discriminating whether the length of the transfer material along the conveying direction is shorter than the distance from said first position to said second position along the moving direction of said intermediate transfer member.

22. An image forming apparatus according to claim 21, wherein when said second mode is selected and when said discriminating means discriminates that the length of the transfer material along the conveying direction is shorter than the distance from said first position to said second position along the moving direction of said intermediate transfer member, said control means switches the peripheral speed of said intermediate transfer member from said first speed to said second speed during said time period.

23. An image forming apparatus according to claim 21, wherein when said second mode is selected and said discriminating means discriminates that the length of the transfer material along the conveying direction is equal to or longer than the distance from said first position to said second position along the moving direction of said intermediate transfer member, said control means maintains the peripheral speed of said intermediate transfer member at said first speed without change during said time period.

24. An image forming apparatus according to claim 18, wherein said intermediate transfer member is in a shape of a belt.

25. An image forming apparatus according to claim 24, further comprising a plurality of supporting rollers for supporting said intermediate transfer member.

26. An image forming apparatus according to claim 25, wherein the monochromatic image on said predetermined image bearing member is transferred on a peripheral surface of said intermediate transfer member wound around one of said plurality of supporting rollers.

27. An image forming apparatus according to claim 26, wherein the monochromatic image on said intermediate transfer member is transferred to the transfer material on said peripheral surface.

28. An image forming apparatus according to claim 18, wherein when said second mode is selected, an image bearing member other than said predetermined image bearing member is apart from said intermediate transfer member.

29. An image forming apparatus according to claim 28, said predetermined image bearing member is apart from said intermediate transfer member during said time period.

30. An image forming apparatus according to claim 18, wherein a peripheral speed of said predetermined image bearing member when said first mode is selected is the same as a peripheral speed of said predetermined image bearing member when said second mode is selected.

31. An image forming apparatus according to claim 18, further comprising fixing means for fixing an image to the transfer material after the image is transferred from said intermediate transfer member to the transfer material, wherein a conveying speed of the transfer material conveyed by said fixing means when said first mode is selected is the same as a conveying speed of the transfer material conveyed by said fixing means when said second mode is selected.

* * * * *

UNITED STATES PATENT AND TRADEMARK OFFICE

CERTIFICATE OF CORRECTION

PATENT NO. : 6,324,358 B1
DATED : November 27, 2001
INVENTOR(S) : Hiroshi Sahara It is certified that error appears in the above-identified patent and that said Letters Patent is hereby corrected as shown below:

Title page,
Item [57] ABSTRACT, line 4, "transfer" should read -- intermediate transfer --.

Column 1,
Line 32, "10c" should read -- 101c, --.

Column 3,
Line 67, "lid." should read -- 11d. --.

Column 4,
Line 2, "toner" (1st occurrence) should read -- toners --.
Line 18, "guides" should read -- guide --.
Line 42, "(polyvinyliden" should read -- polyvinylidene --.
Line 47, "chroroprene" should read -- chloroprene --.
Line 53, "a round)" should read -- around) --.

Column 5,
Line 63, "superpose" should read -- superimpose --.

Column 7,
Line 10, "each" should read -- individual --.
Line 47, "t" should be deleted.

Column 11,
Line 13, "material" should read -- material, --.
Line 43, "shorter" should read -- shorter than --.

UNITED STATES PATENT AND TRADEMARK OFFICE

CERTIFICATE OF CORRECTION

PATENT NO. : 6,324,358 B1
DATED : November 27, 2001
INVENTOR(S) : Hiroshi Sahara It is certified that error appears in the above-identified patent and that said Letters Patent is hereby corrected as shown below:

Column 13,
Line 46, "17 or 18," should read -- 19 or 20, --.

Signed and Sealed this

Twenty-first Day of May, 2002

*Attest:*

*Attesting Officer*

JAMES E. ROGAN
*Director of the United States Patent and Trademark Office*